United States Patent [19]

Sterling

[11] Patent Number: 4,989,820

[45] Date of Patent: Feb. 5, 1991

[54] HOLDER FOR CHRISTMAS TREES AND THE LIKE

[75] Inventor: Lawrence G. Sterling, Greensboro, N.C.

[73] Assignee: Overload, Ltd., Kowloon, Hong Kong

[21] Appl. No.: 455,032

[22] Filed: Dec. 22, 1989

[51] Int. Cl.[5] ..... F16M 13/00

[52] U.S. Cl. ..... 248/523; 47/42; 248/534

[58] Field of Search ..... 248/523, 524, 519, 511, 248/534, 540; 47/40.5, 42, 24

[56] References Cited

U.S. PATENT DOCUMENTS

| | | | |
|---|---|---|---|
| 1,505,357 | 8/1924 | Lindquist . | |
| 1,528,883 | 3/1925 | Lindquist . | |
| 1,732,284 | 10/1929 | Schulze . | |
| 1,772,693 | 8/1930 | Van Dorin . | |
| 2,327,403 | 8/1943 | Cowpanger | 248/523 X |
| 2,421,140 | 5/1947 | Blaner . | |
| 2,598,021 | 5/1952 | Schwanke | 248/511 X |
| 2,634,070 | 4/1953 | Aguettaz | 248/524 |
| 2,815,908 | 12/1957 | Scandland | 47/40.5 |
| 2,933,274 | 4/1960 | Mausolf | 47/40.5 |
| 3,337,169 | 8/1967 | Griffin | 47/40.5 |
| 3,582,028 | 6/1971 | Purdy . | |
| 4,788,140 | 10/1988 | Karlewski | 248/524 |
| 4,848,027 | 7/1989 | Skierwiderski | 248/523 |

*Primary Examiner*—Ramon O. Ramirez

*Attorney, Agent, or Firm*—Sughrue, Mion, Zinn, Macpeak & Seas

[57] ABSTRACT

A holding device for holding a Christmas tree and the like in an upright position which includes a ring-like member disposed in a horizontal plane. The ring-like member has fingers which extend inwardly thereof in the horizontal plane. The fingers are spaced around an edge of the ring-like member, and each of the fingers has a width which is less than the length between adjacent fingers along the edge of the ring-like members.

15 Claims, 3 Drawing Sheets

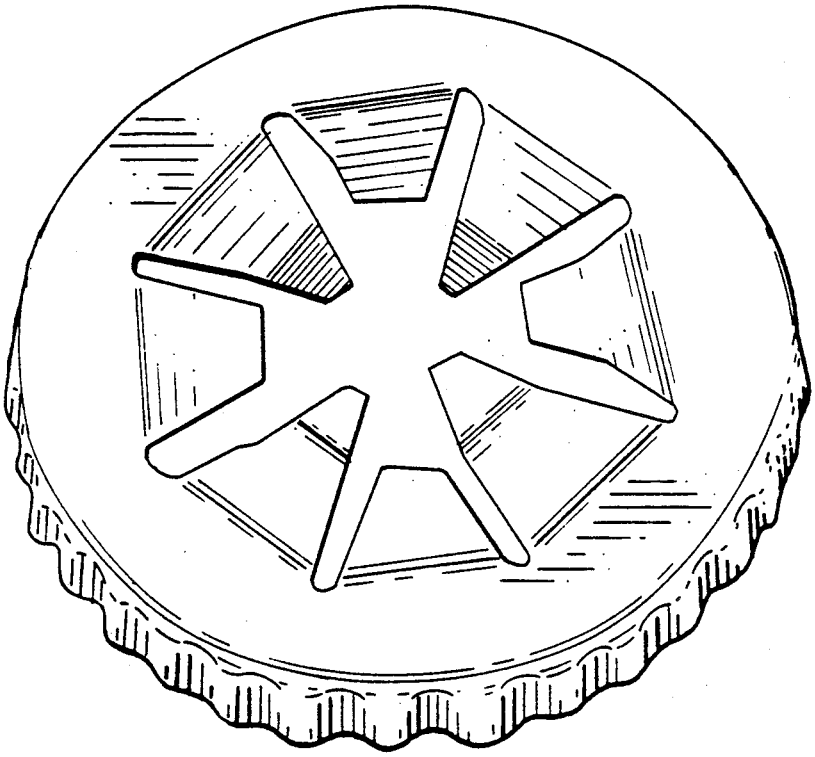
FIG. 1
PRIOR ART
FIG. 2
PRIOR ART
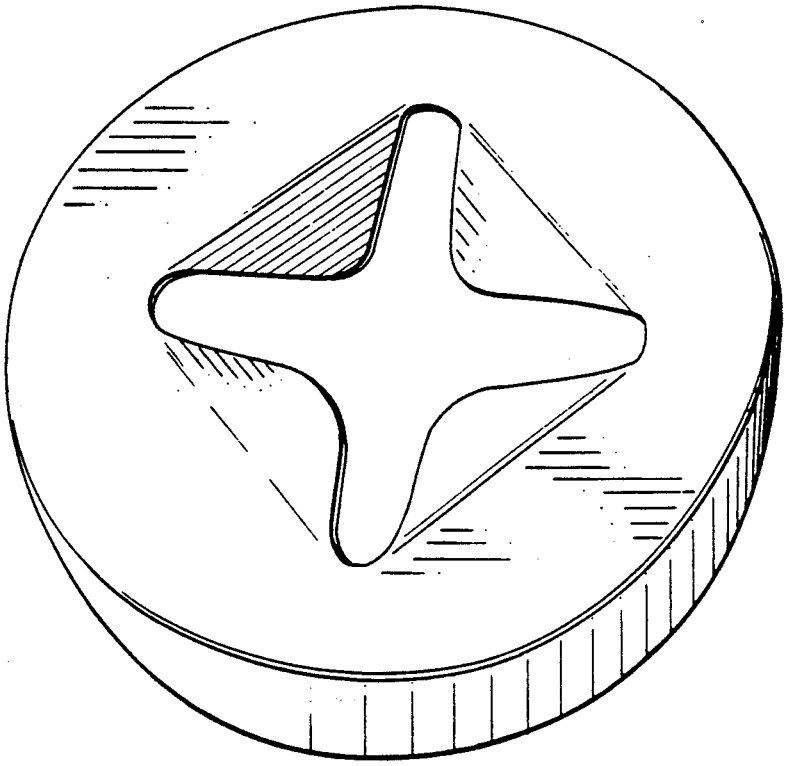

HOLDER FOR CHRISTMAS TREES AND THE LIKE

FIELD OF THE INVENTION

The present invention relates to a device for holding, in an upright position, Christmas trees, flagstaffs and other objects of the same general character.

BACKGROUND OF THE INVENTION

Devices for holding Christmas trees and the like in an upright position are well known in the art. The following are examples of such prior art Christmas tree holders.

U.S. Pat Nos. 1,505,357 and 1,528,883, both to Lindquist, disclose a holder for trees and the like which includes a cone supported by legs, and springs which are secured to the inside surface of the cone. In operation, a tree butt is inserted into the cone, and the cone in conjunction with the springs serve as "resilient tree trunk centering means".

U.S. Pat. No. 3,582,028 to Purdy discloses a tree holder including an elongated container supported by legs, and resilient gripping elements secured to the inner side of the container for engaging the butt of a tree inserted in the container.

U.S. Pat. No. 1,732,284 to Schulze discloses a tree holder including supporting legs, upper and lower rings, and leaf-springs provided between the upper and lower rings. The leaf-springs serve to hold a tree trunk, inserted through the rings, in an upright position.

U.S. Pat. No. 1,772,693 to Dorin discloses a tree holder including a cup member and inwardly bowed portions for gripping a tree trunk inserted in the cup member.

U.S. Pat. No. 2,421,140 to Blaner discloses a Christmas tree stand including a cylindrical member and screws. The tree trunk is clamped in the cylindrical member by means of the screws.

The prior art tree holders discussed above all have a relatively complex design, thereby making these tree holders difficult and time-consuming to assemble. In particular, most of the various springs and other resilient gripping elements of these prior art tree holders must be individually attached by screws and bolts.

In an attempt to overcome these shortcomings of the prior art tree holders, the tree trunk gripping adapters shown in FIGS. 1 and 2 were developed. These adapters were designed to be used with a supported cylindrical member. Each of these gripping adapters includes an open space at the center thereof through which a tree is inserted. The adapters of FIGS. 1 and 2 obviate the need for separately bolted resilient springs or other gripping elements. However, the designs of the adapters shown in FIGS. 1 and 2 have not been effective in practice. In particular, the adapter designs of FIGS. 1 and 2 have not been sufficiently resilient to accommodate and hold a plurality of different sized and shaped tree trunks. This is a serious shortcoming because it is rare that the trunk of a Christmas tree used during a given year has the same size and shape as the trunk of a Christmas tree used during the preceding or next year.

FIG. 3 shows a further prior art Christmas tree holder/stand which has been widely used, and is perhaps the most popular of all Christmas tree holders presently available. The Christmas tree holder/stand of FIG. 3 is of relatively simple design, and can be easily assembled. Referring to FIG. 3, the Christmas tree holder includes a cup member 2 having an outer lip edge portion 2*a* and a spike (not shown) disposed at the bottom center thereof, four support legs 4 which are hinged to the lip edge portion 2*a*, and an annular member 6 which is disposed on, and is supported by, the legs 4. The annular member 6 includes four holes 8 and four screws (not shown) are provided when purchasing this Christmas tree holder.

In operation, a tree butt is inserted through the annular member 6 so that the bottom of the tree butt engages the spike. The four screws are then screwed into the tree trunk through the four holes 8 to hold the tree in an upright position. In order to remove the tree, the four screws are unscrewed from the tree trunk, thereby allowing the tree to be removed from the tree stand.

Although the tree stand shown in FIG. 3 is of relatively simple design and has enjoyed much commercial success, it has shortcomings in operation. More specifically, when positioning the tree in the tree holder, it is difficult to screw the screws into the tree trunk. For larger trees, the screws must be screwed deep into the tree trunk to adequately hold and position the tree. This often cannot be accomplished by hand, and therefor pliers must be used to grip the screws as they are screwed into the tree trunk. Further, to remove the tree, the screws must be unscrewed from the tree trunk. Accordingly, the same problems encountered when screwing the screws into the tree are present when the screws are unscrewed from the tree.

SUMMARY OF THE INVENTION

It is a general object of the present invention to provide a device for holding Christmas trees and the like in an upright position.

It is another object of the invention to provide a Christmas tree holder which can accommodate different sized and shaped trees, and can be repeatedly used.

It is another object of the invention to provide an adapter which obviates the problems associated with the prior art Christmas tree stands, and in particular, the widely-used prior art Christmas tree shown in FIG. 3.

These and other objects are accomplished by the present invention which provides a device for holding Christmas trees and the like comprising:

A ring-like member disposed in a horizontal plane and having a plurality of spaced fingers extending from an edge thereof towards a center open space of the ring-like member, each of the plurality of fingers extending substantially in the horizontal plane, and having a width which is less than the distance between adjacent fingers along the edge of the ring-like member: and means for opening and closing the ring-like member.

In another embodiment of the invention, the ring-like member comprises two substantially U-shaped portions which are fitted together, and means are provided for securing the two U-shaped portions together.

BRIEF DESCRIPTION OF THE DRAWINGS

FIGS. 1 and 2 are perspective views of prior art tree gripping adapters.

DETAILED DESCRIPTION OF THE PREFERRED EMBODIMENTS

Figure 4:
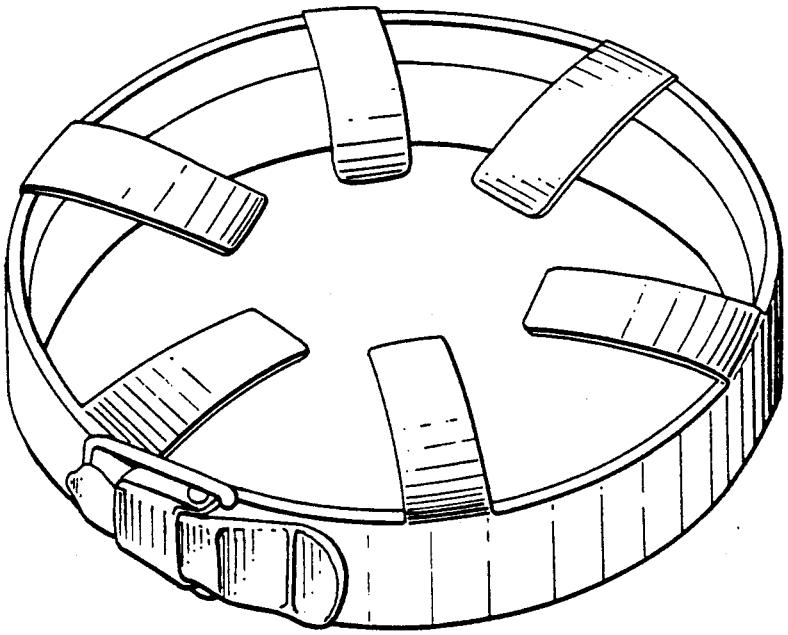
FIG. 4 is a perspective view of an adapter according to a first embodiment of the invention.

FIG. 4 shows an adapter 10 according to a first embodiment of the invention. The adapter 10 includes a ring-like member 12 having six integral fingers 14 which extend toward the middle open space defined by the adapter, and a clasp 16 for opening and closing the adapter 10.

The ring-like member 12 and integral fingers 14 are constructed from a resilient spring steel one-piece unit which is formed using conventional presses and dies. This one-piece unit includes a rectangular member (which corresponds to the ring-like member 12) and fingers 14 extending from one edge portion of the rectangular member. The two ends of the rectangular member are connected together through the clasp 16 to form the ring-like member 12. The clasp 16 may be connected by first curling the two end portions of the rectangular member back to form respective hooks, and then attaching ends of the clasp 16 between the formed hooks. After the clasp 16 is attached, the hooks are bent further back around the ends of the clasp 16 until a closed loop is formed, thereby securing the clasp 16 to the ring-like member 12.

The adapter 10 may be constructed of a 20- or 22-gauge AISI 1040 low alloy-high carbon-95 points, cold-rolled spring steel which provides structural integrity for the adapter, while at the same time allows the ring-like member 12 and fingers 14 to be sufficiently resilient as will be discussed below in connection with the operation of the adapter 10.

Figure 3:
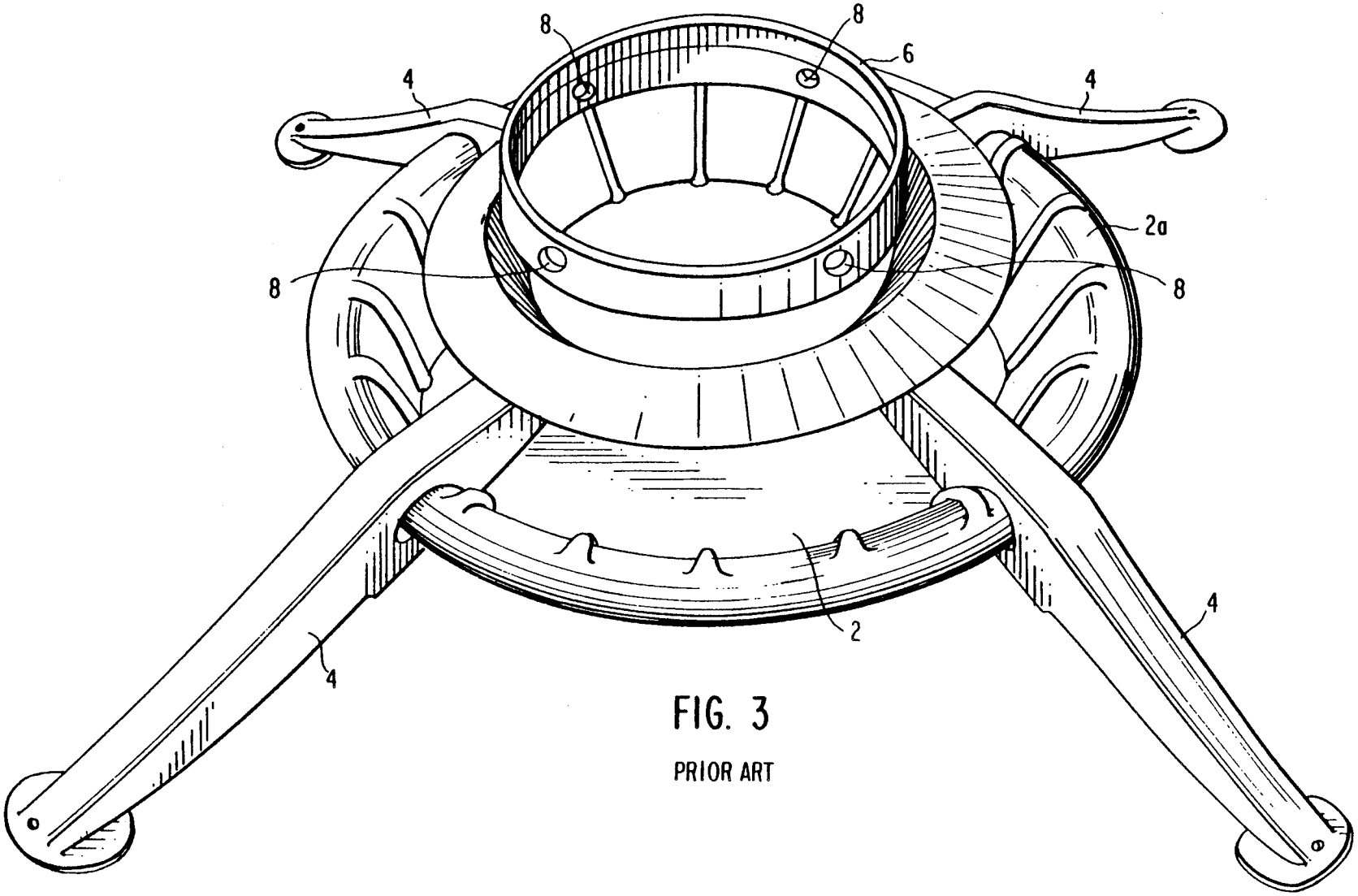
FIG. 3 PRIOR ART
FIG. 3 is a perspective view of a widely-used prior art Christmas tree holder.

The ring-like member 12 has an inner diameter (when the clasp 16 is closed as shown in FIG. 4), which is sufficient to extend around, and firmly contact the outside surface of the annular member 6 of the conventional tree stand shown in FIG. 3.

The fingers 14 are approximately $2\frac{1}{4}$ inches long, and $\frac{3}{4}$ inch wide. The fingers bow slightly downward as they extend toward the middle open space defined by the adapter, and are equally spaced from each other along the top edge of the ring-like member 12.

The operation of the adapter 10 will now be described. In particular, the adapter will be described in conjunction with the conventional tree stand shown in FIG. 3.

In operation, the conventional tree stand of FIG. 3 is first placed in the desired location where it is to support a Christmas tree. The clasp 16 of the adapter is then unlocked, thereby opening the adapter (i.e., since the ring-like member 12 is made of flexible spring steel material, the diameter of the ring-like member 12 is enlarged upon unlocking the clasp 16). The opened adapter 10, with the enlarged diameter of the ring-like member 12, is then placed around the outer surface of the annular member 6 (FIG. 3). The clasp 16 is then locked, thereby closing the adapter 10 and reducing the diameter of the ring-like member 12 so that the inner surface thereof is tightly pressed against the outer surface of the annular member 6.

Once the ring-like member 12 of adapter 10 is tightly secured against the outer surface of the annular member 6, the butt of a tree is inserted through the open space defined by the adapter 10 and annular member 6 until the bottom end of the tree butt engages the spike of cup 2. As the butt moves downward towards the spike, it engages and deflects the fingers 14. The fingers 14 are made of a resilient flexible spring steel material, and will resist outward movement of the tree butt, thereby tightly gripping the tree butt and securely holding the tree in place.

The butt of the tree may be crooked. Such crookedness is compensated for by the flexible fingers 14 of the present invention. More specifically, one or more of the fingers 14 will resiliently deflect by a greater or a lesser amount, thereby compensating for any crookedness of the butt and enabling the tree to be maintained in a straight upright position. At the same time, the fingers 14 permit a secure gripping of the crooked butt, thereby preventing the tree from rocking.

When the tree is to be removed from the tree holder of FIG. 3 (having the adapter 10 pressed against the outside surface of annular member 6). the clasp 16 is unlocked, thereby opening the adapter 10 (i.e., enlarging the diameter of the ring-like member) and releasing the fingers 14 from engagement with the tree butt. The tree can now be easily removed by simply pulling it away from the tree holder.

Figure 5:
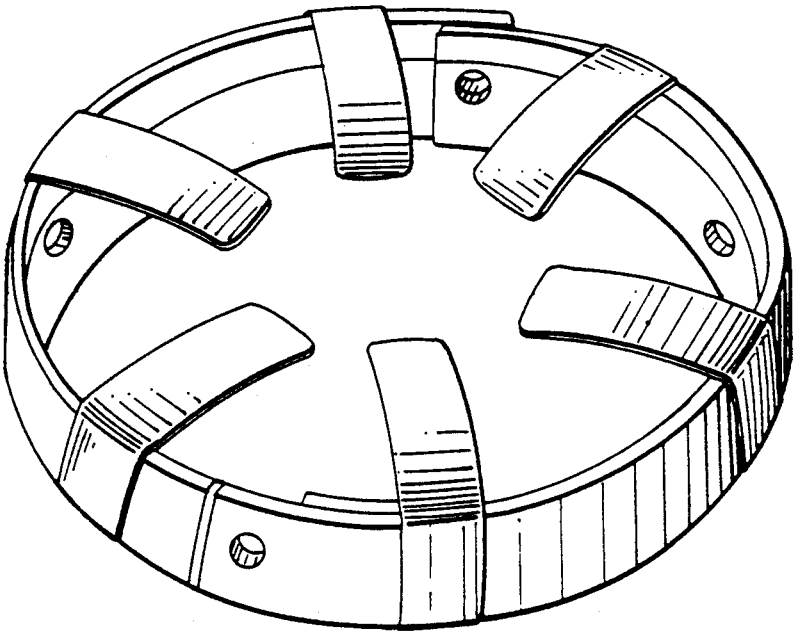
FIG. 5 is a perspective view of an adapter according to a second embodiment of the invention.

FIG. 5 shows another embodiment of the tree holder adapter according to the invention. As shown in FIG. 5, the adapter 18 according to this embodiment includes a ring-like member 20 formed by fitting together two generally U-shaped portions 20*a* and 20*b*, six fingers 22 fixedly secured to the two U-shaped portions 20*a* and 20*b*, and holes 24 formed in the U-shaped portions.

The U-shaped portions 20*a* and 20*b* may be formed using conventional presses and dies, and each of the U-shaped portions 20*a* and 20*b* includes three spaced-apart holes such that when portions 20*a* and 20 *b* are fitted together to form ring-like member 20, two of the holes of each of the portions 20*a* and 20*b* are aligned, thereby providing ring-like member 20 with four holes 24, as shown in FIG. 5. The four holes 24 cooperate with the four holes 8 of the annular member 6 (FIG. 3) as will be discussed in more detail below in connection with the operation of adapter 18.

Each of the U-shaped portions 20*a* and 20*b* includes three fingers 22 which are tack-welded to the outside surface of portions 20*a* and 20*b* such that fingers 22 are equally spaced from one another. Accordingly, when U-shaped portions 20*a* and 20*b* are fitted together, the ring-like member 20, having six fingers 22, is formed.

The dimensions and material of the adapter 18 are the same as that of the adapter 10 of FIG. 4. Further, like the fingers 14 of adapter 10 (FIG. 4), the fingers 22 of adapter 18 bow slightly downward as they extend toward the middle open space defined by adapter 18.

The operation of adapter 18 will now be described. The adapter 18 is also particularly suited for use with the conventional tree stand of FIG. 3.

In operation, the conventional tree stand of FIG. 3 is first placed in the desired location where it is to support a Christmas tree. The two U-shaped portions 20*a* and 20*b* are then fitted together around annular member 6 (FIG. 3) so that the four holes 24 of the formed ring-like member 18 are respectively aligned with the four holes 8 of annular member 6. The four screws provided with the conventional tree stand of FIG. 3 are then screwed into the four aligned holes, thereby securing the inside surface of ring-like member 20 against the outside surface of annular member 6. The adapter 18 is now securely provided on the annular member 6. The fingers 22 of adapter 18 function in the same manner as fingers 14 of adapter 10 (FIG. 4) to hold a Christmas tree firmly in an upright position.

In order to remove the tree from the conventional tree holder of FIG. 3 (having adapter 18 provided thereon), the four screws are unscrewed from the four aligned holes (i.e., holes 24 of adapter 18 and holes 8 of annular member 6). thereby allowing the two U-shaped portions 20*a* and 20*b* of the ring-like member 20 to be unfitted from each other and removed from the annular member 6. The tree can now be easily removed by simply pulling it away from the tree holder.

It should be noted that the ring-like member of the adapter 10 shown in FIG. 3 can include four holes or slots which are similar to the holes 24 provided in the ring-like member 20 shown in FIG. 4. Such holes for the adapter 10 can be aligned with the holes 8 of the annular member 6 (FIG. 3) when adapter 10 is placed around annular member 6, and serve, along with four screws inserted therethrough, as means for positioning the ring-like member 20 relative to the annular member 6.

The adapters 10 (FIG. 4) and 18 (FIG. 5) have been successfully tested with 3 inch, 4 inch and 5 inch diameter trees using the conventional tree holder of FIG. 3. Further, after releasing a 5 inch diameter tree, a 3 inch diameter tree was reinserted. The adapters 10 and 18 again successfully held the 3 inch tree, showing that the adapters 10 and 18 have sufficient resiliency for repeated use.

Although the present invention has been described in conjunction with the prior art Christmas tree holder of FIG. 3, those skilled in the art will understand that the present invention can be utilized with other holders for trees and the like.

Further, although the present invention has been described in connection with particular preferred embodiments, those skilled in the art will understand that variations and modifications are possible without departing from the spirit of the invention which is only limited by the following claims.

What is claimed is:

1. A holding device for holding a Christmas tree and the like in an upright position, comprising:

a resilient ring-like member disposed in a horizontal plane, said resilient ring-like member having a plurality of resilient integral fingers which extend inwardly of said resilient ring-like member in the horizontal plane, said fingers being spaced around an edge of said ring-like member, and each of said fingers having a width which is less than the length between adjacent fingers along the edge of said ring-like member; and means for opening and closing said resilient ring-like member to increase and decrease, respectively, a diameter thereof.

2. The holding device as claimed in claim 1, wherein said ring-like member and said fingers are made from spring steel.

3. The holding device as claimed in claim 1, wherein there are six fingers equally-spaced from each other along the edge of said ring-like member.

4. The holding device as claimed in claim 1, wherein each of said fingers bow slightly downward from the horizontal plane.

5. In a Christmas tree holder of the type comprising a cup, a plurality of legs hinged to an outer edge of said cup, and an annular member supported by said plurality of legs, the improvement comprising:

a ring-like member having a plurality of resilient spaced fingers extending inward from an edge of said ring-like member, ends of said fingers fixedly secured thereto and defining an open space through which a tree can be inserted, each of said fingers having a width which is less than the distance between adjacent fingers along the edge of said ring-like member, and an inner diameter of said ring-like member being such that said ring-like member can be disposed around an outside surface of said annular member.

6. The tree holder as defined in claim 5, wherein said ring-like member comprises two generally U-shaped members which can be fitted together to form said ring-like member, wherein an inner diameter of said formed ring-like member is such that said formed ring-like member can be disposed around said annular member, and wherein said fingers are tack welded to said two U-shaped members.

7. The tree holder as defined in claim 6, wherein the annular member includes a plurality of spaced holes, and wherein each of said two U-shaped portions has spaced holes such that when said formed ring-like member is disposed around said annular member, the holes of said ring-like member can be aligned with the holes of said annular member.

8. The tree holder as defined in claim 7, wherein each of said U-shaped portions includes three fingers such that said formed ring-like member has six fingers which are equally-spaced from one another.

9. A holding device for holding a Christmas tree and the like in an upright position, comprising:

a ring-like member having a plurality of resilient fingers fixedly secured thereto and extending inwardly of said ring-like member, said ring-like member comprising a pair of generally U-shaped portions which are fitted together to form said ring-like member, said fingers being spaced around an edge of said formed ring-like member, and each of said fingers having a width which is less than the length between adjacent fingers along the edge of said formed ring-like member.

10. The holding device as claimed in claim 9, wherein said U-shaped portions and said fingers are made from spring steel.

11. The holding device as claimed in claim 9, wherein there are six fingers equally-spaced from each other along the edge of said formed ring-like member.

12. The holding device as claimed in claim 9, wherein each of said fingers bow slightly downward.

13. In a Christmas tree holder of the type comprising a cup, a plurality of legs hinged to an outer edge of said cup, and an annular member supported by said plurality of legs, the improvement comprising:

a ring-like member having a plurality of resilient spaced fingers extending inward from an edge of said ring-like member, ends of said fingers defining an open space through which a tree can be inserted, each of said fingers having a width which is less than the distance between adjacent fingers along the edge of said ring-like member, and an inner diameter of said ring-like member being such that said ring-like member can be disposed around an outside surface of said annular member, and wherein said fingers are integral with said ring-like member, said ring-like member is made of a resilient material, and wherein said tree holder further comprises means for opening and closing said resilient ring-like member to increase and decrease, respectively, a diameter thereof.

14. The tree holder as defined in claim 13, wherein said opening and closing means comprises a clasp fixedly secured to said ring-like member.

15. A holding device for holding a Christmas tree and the like in an upright position comprising:

a resilient ring-like member disposed in a horizontal plane, said resilient ring-like member having a plurality of integral fingers which extend inwardly of said resilient ring-like member in the horizontal plane, said fingers being spaced around an edge of said ring-like member, and each of said fingers having a width which is less than the length between adjacent fingers along the edge of said ring-like member; and means for opening and closing said resilient ring-like member to increase and decrease, respectively, a diameter thereof, and wherein said opening and closing means comprises a clasp fixedly secured to said ring-like member.

* * * * *